US005103592A

United States Patent [19]

Janitzky

[11] Patent Number: 5,103,592

[45] Date of Patent: Apr. 14, 1992

[54] PROTECTIVE DEVICE FOR ANTI-AIRCRAFT INSTALLATIONS AND NUCLEAR POWER STATIONS

[76] Inventor: Manfred Janitzky, Königstrasse 10, 4053 Jüchen 5, Fed. Rep. of Germany

[21] Appl. No.: 458,652

[22] PCT Filed: Jun. 9, 1988

[86] PCT No.: PCT/DE88/00339

§ 371 Date: Jan. 31, 1981

§ 102(e) Date: Jan. 31, 1981

[87] PCT Pub. No.: WO88/10352

PCT Pub. Date: Dec. 29, 1988

[30] Foreign Application Priority Data

Jun. 16, 1987 [DE] Fed. Rep. of Germany ... 8708486[U]

[51] Int. Cl.[5] ..... E05D 7/00

[52] U.S. Cl. ..... 49/401; 49/395; 49/501; 292/DIG. 60; 292/DIG. 61; 292/341.18

[58] Field of Search ..... 49/401, 395, 40, 400, 49/402, 501, 503, 41, 381; 292/DIG. 60, DIG. 61, 341.18, 341.19

[56] References Cited

U.S. PATENT DOCUMENTS

| | | | |
|---|---|---|---|
| 1,768,793 | 7/1930 | Sheard | 49/381 X |
| 1,907,091 | 5/1933 | Pettit | 49/401 |
| 2,123,106 | 7/1938 | Haberstump | 40/401 X |
| 2,295,324 | 9/1942 | Arthur | 292/DIG. 60 X |
| 2,315,239 | 3/1943 | Young | 292/341.18 X |
| 2,770,850 | 11/1956 | Graham | 49/401 |
| 3,189,951 | 6/1965 | Rosenfeld | 49/171 |
| 3,245,709 | 4/1966 | Rosenberger | 292/341.18 X |
| 4,523,407 | 6/1985 | Miller | 49/400 X |
| 4,906,036 | 3/1990 | James | 292/DIG. 60 X |

*Primary Examiner*—Philip C. Kannan
*Attorney, Agent, or Firm*—K. S. Cornaby

[57] ABSTRACT

A protective door device for anti-aircraft installations and nuclear power stations has a door opening in a wall preferably designed as a concrete wall. The opening is surrounded on all sides by the wall and can be closed by means of a protective door which overlaps the wall. The protective door has a central lock and a bowl-shaped metal door leaf reinforced by ribs, from which one-piece support arms project. Two bearing bolts on which two door hinges are mounted are inserted in the wall near the door opening and pockets for adjustable engagement of lock bails of the central lock are arranged in the intrados of the door opening.

8 Claims, 4 Drawing Sheets

PROTECTIVE DEVICE FOR ANTI-AIRCRAFT INSTALLATIONS AND NUCLEAR POWER STATIONS

Figure 1:
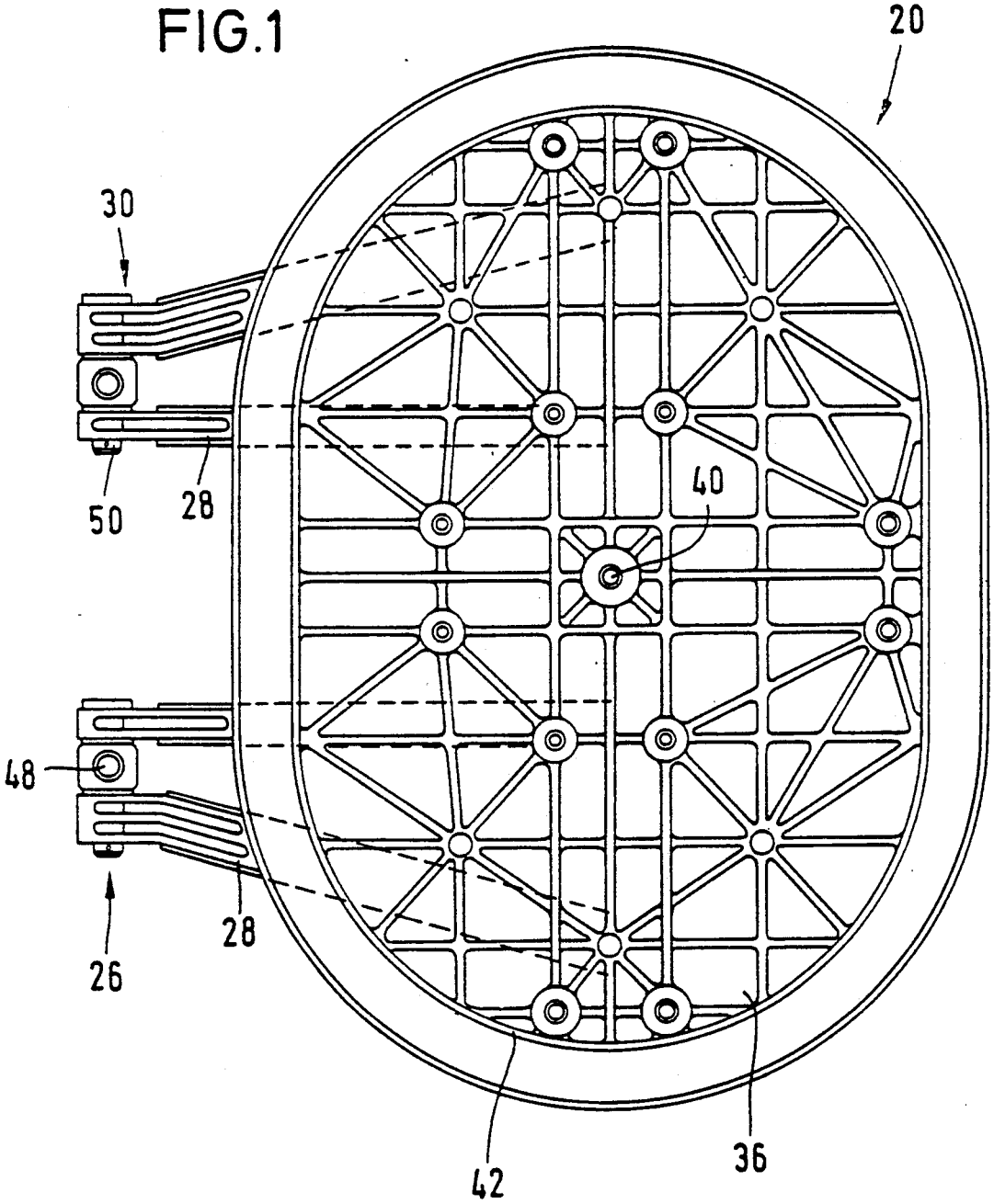

The invention pertains to a protective door device for anti-aircraft installations and nuclear power stations. It has a door opening in a wall preferably designed as a concrete wall and a protective, closeable door that overlaps the wall.

In the event of an atomic accident or explosion there occurs in addition to such immediate effects as a pressure wave and its subsequent suction wave the release of radio-active rays. These remain active for a long time. If, for example, atomic bombs with supplemental devices—that is, Plutonium bombs—are detonated, Poisonous gases, which are generally radio-active, are also released.

In the event of nuclear catastrophies, therefore, or if tactical nuclear weapons are employed, all protective devices must on the one hand be secure against all pressure waves and, on the other hand, they must still seal to such a degree that the protective device is impervious to all subsequent effects but especially those which derive from radio-active material. All this makes truly extraordinary demands on a protective door device, but these demands are, in general, not met by doors currently in service. A protective door device should be capable of withstanding a pressure wave of 10 bar (as a reflected pressure wave) and continue to provide total sealing, and it should also survive the subsequent suction wave and continue to seal properly. These two pressure waves, which follow rapidly one after the other and, acting in opposite directions, cause pressure and then suction, place high demands on the mechanical rigidity.

Proceeding from these considerations it is the purpose of the invention to create for anti-aircraft installations and nuclear power stations a protective door which will continue to seal while withstanding both a reflected pressure wave of 10 bar and the subsequent suction wave and which can be produced at a reasonable price.

This problem is solved by means of a protective device for anti-aircraft installations and nuclear Power stations. It has a door opening in a wall preferably designed as a concrete wall. The opening is surrounded on all sides by the wall and can be closed by means of a protective door which overlaps the wall. The protective door has a central lock and a bowl-shaped metal door insert which is reinforced by ribs, and from the longitudinal edges of the door one-piece support arms project. Two bearing bolts on which two door hinges are mounted are inserted in the wall near the door opening, and pockets for adjustable engagement of lock bails of the central lock are arranged in the door jambs.

The door insert, made of aluminum or steel, is cast in one Piece by casting or by casting under pressure. It acquires its ability to withstand the reflected pressure wave though on the one hand the convex shape that it presents to this pressure wave—the door is bowl shaped—and, on the other, through the reinforcing ribs. No frame is used. Rather, the door is hung on hinges which are set directly in the wall by means of two bearing bolts. The door opening is surrounded on all sides by the wall. Thus it does not, as is the case with a door to a room, border on a floor or on another surface. The door opening is preferably round—at least it should not be square. Especially recommended is an oval shape—and by oval should be understood in addition to egg-shaped a design that is formed by two semicircles and the straight lines which join them. (cf. the oval in a stadium).

When the pressure wave is felt the door leaf is pressed against the outside wall around the door opening. During the following suction wave the door leaf is held in place by the lock bails. Moreover, as the grip of the lock bails in the pockets can be adjusted, a good seal can be maintained even while the suction wave can be felt. In this respect it is especially advantageous if the contact areas of the lock bails are held elastically in place in the pockets. This is achieved preferably by a spring which loads the pertinent ends of the lock bails in a direction that is transverse to the main surface of the door leaf. A loading in directions that are transverse to the longitudinal axis of the lock bails is advantageous.

The door leaf is preferably oval, at least it should be symmetrical when turned through 180 degrees. In this way just one type of door needs to be manufactured, and the hinges can be affixed on either the left or the right side.

The door leaf has preferably an outer surface that is smooth or spherically or spherically-cylindrically rounded. This outer surface should form at the edges an overlapping area, and the door leaf is to exceed the size of the door opening in the wall by the equivalent of this overlapping area. The seal is attached to the door on this overlapping area and placed so that it faces the wall. Directly beside the seal and projecting away from the inside of the door there is mounted a rotatable rib in the form of a short supporting sleeve. The outer dimensions of this rib are to be just minimally shorter than the inner dimensions of the door opening. On the free edge of the overlapping area a reinforcing edge projects outward. This reinforcing edge supports the overlapping area in such a way that it is not sheared off during the shock wave. Such an arrangement of the two flanges together with the enclosed seal is essentially "z" shaped, and it has proved to be especially advantageous. It provides the door leaf with the mechanical rigidity that is necessary if it is to withstand successfully the shock wave.

From the rib that completely encircles the door leaf on its outer edge whole systems of ribs cover the total inner surface of the door insert. These meet and branch out from a veritable host of nubs. In much simplified terms, the reinforcing that is achieved by these ribs can be expressed thus: longitudinally three parallel ribs transverse the centre section of the door insert from the top to the bottom. These ribs intersect and join up with three ribs which, equidistant from one another, cross the door leaf from one side to the other. Between this set of three longitudinal ribs and the outer rib there is mounted on either side another, straight rib. Thus, the door is reinforced longitudinally by five parallel ribs. Transversely, three additional ribs are mounted on each side between the three center ribs and the outside rib. Thus transversely the door is reinforced by no fewer than eleven ribs. In addition, the sectors which are formed by the intersection of each of the three inner longitudinal and transverse ribs are reinforced by diagonal ribs.

The support arms are mounted in duplicate and are V-shaped in the area of the door hinges. They are attached to the outside of the door.

Further characteristics and advantages of the invention will be evident from both the remaining claims and the following description of one possible version of the door, it being understood that the version discussed does not limit in any way the scope of the claims sought. This version is described more closely with reference to the drawings.

Figure 2:
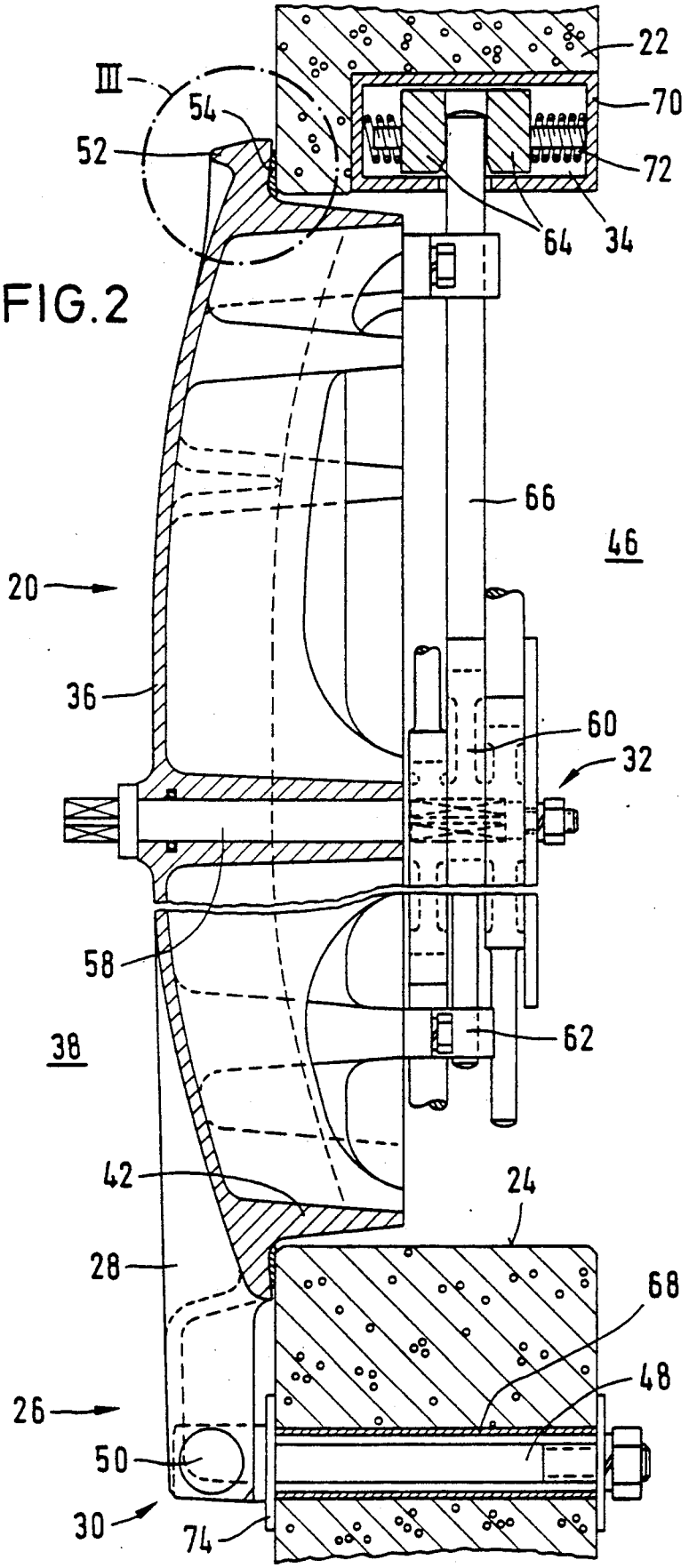
Figure 3:
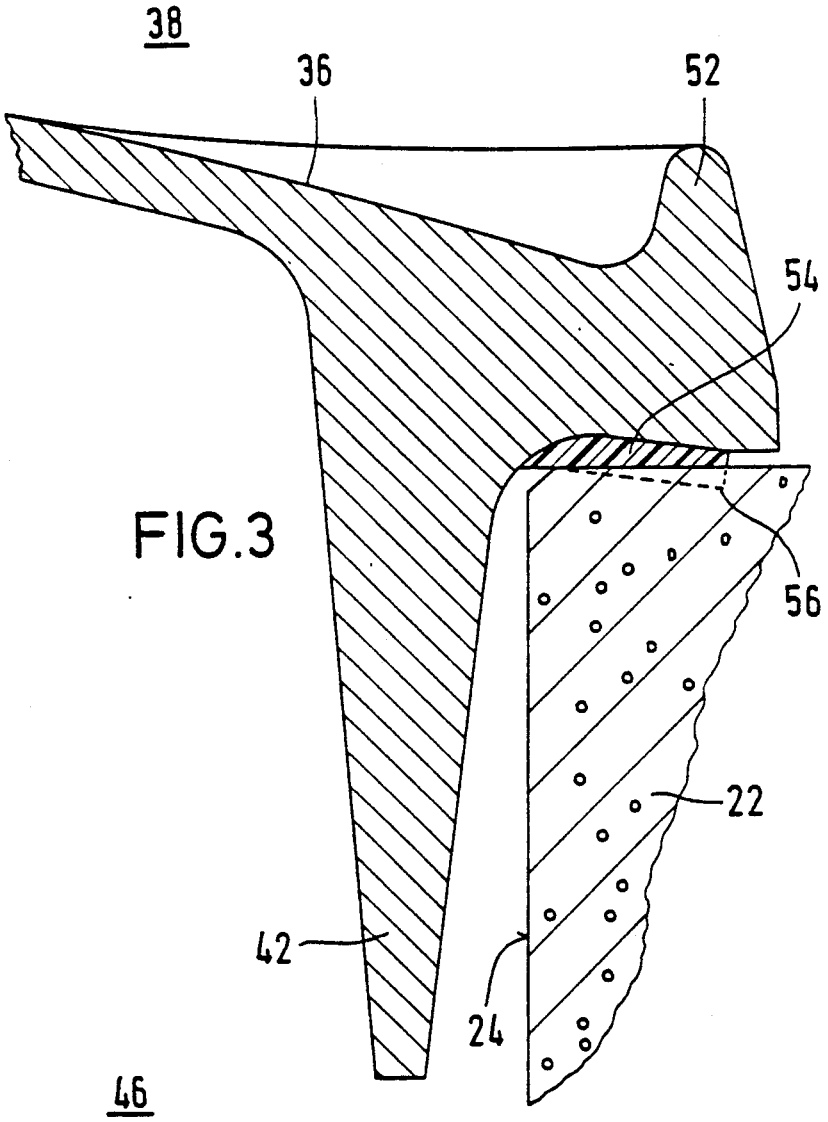
Figure 4:
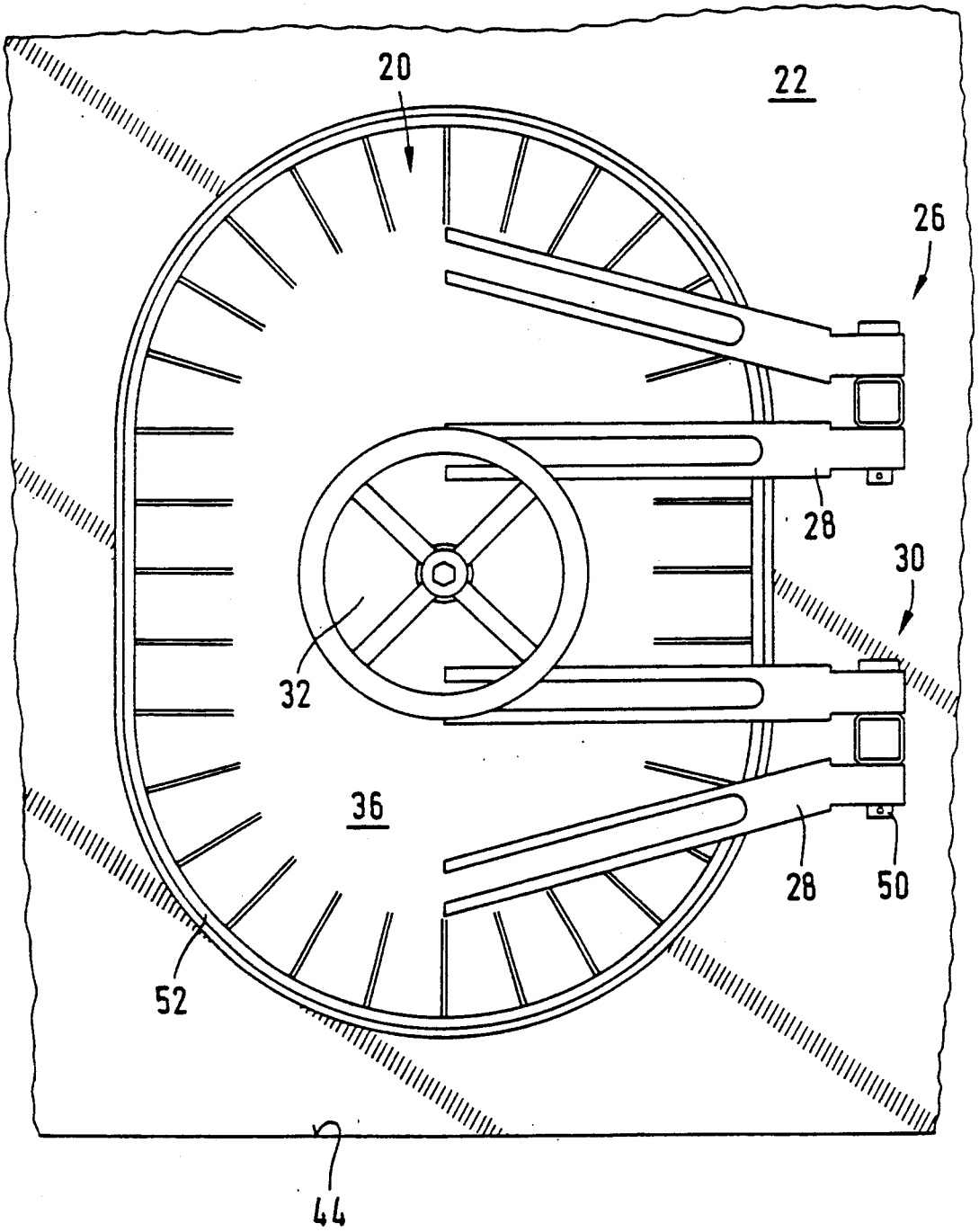

Of these:

FIG. 1 the inside view of the door leaf of the protective door device;

FIG. 2 a horizontal cross section through a protective door device with a door leaf constructed according to FIG. 1;

FIG. 3 Detail III of FIG. 2 enlarged;

FIG. 4 a plan view on to the outside surface of a protective device constructed in accord with the idea and details of this invention.

The protective door device constructed according to these drawings consists of a protective door (20), a door opening (24) that is cited in a wall (22), two hinging arrangements each with support arms (28) and hinges (30) as well as a central locking device (32) to which belong pockets (34) in the door jambs (24).

The protective door consists essentially of an oval shaped door leaf (36). The surface of this door, which is shaped like a shield and mounted so as to present a convex surface to the pressure side (38), overlaps the door opening (24) all around when in the closed position (shown in the drawings). Around its outer rim, the door leaf has an edge which is essentially flat, approximately 25 to 50 mm thick and reinforced inwardly by a system of ribbing that is now described in greater detail: A net of ribs which follow the main directions of the door (36) transverses it through its midpoint (40). To the left and right of this middle point additional ribs spaced approximately 6 cm. apart are mounted. Thus a three-ribbed cross, which in the vicinity of the middle Point (40) is reinforced by further diagonal ribs, is formed. The four sectors thus formed are reinforced by further ribs. These ribs are joined to an encircling rib (42) that completely surrounds the oval-shaped door leaf. All the ribs are manufactured in one piece on the door leaf (36) and merge without a break into the ribs that they intersect or are joined to. The external edge of the rib that encircles the door leaf (42) defines for all practical terms the door opening (24) which is but minimally larger than the external measurement of the encircling rib (42). The decisive factor is that the door leaf (36) is to cover completely the door opening (24) as is especially evident from FIG. 4. A surface (44) is cited there at a distance below the protective door (20) and thus at some distance from the door opening (24). In consequence, a step must be surmounted when passing in or out of the protective door. Only if the door opening is completely surrounded (by the wall) can a proper seal to all sections of the edges of the door be achieved. The enveloping rib (42) and some of the inner ribs project as far into the internal surface (protected side 46) of the door that their free ends are on the one plane. All other ribs are shorter and end before this plane. If the door leaf is approximately 90×130 cm the total height of the enveloping rib (42) is approximately 20 cm, and this rib—like all other ribs—narrows at its free end to approximately 10 mm.

A total of four support arms (28) are mounted on the pressure side (38). These begin on the middle line of the door and run in Pairs to the hinges (30) forming a "V", the axis of each being cited approximately 15 cm. from the adjoining edge of the door leaf (36). Each of the paired support arms (28) ends above and below a bearing bolt (48) that can receive a hinge bolt (50). In each pair of support arms the arm nearest the middle point (40) runs straight and at an angle of 90 degrees to the longitudinal axis of the door. Thus it locks into what is approximately the center of gravity of the pertinent, which is to say upper or lower, door-half. The second support arm begins a few centimeters above—or, respectively, below—the highest—or the lowest—point of the enveloping rib (42) but on the opposite side.

The door leaf (36) together with its ribs and the total of 4 support arms is manufactured (cast) in one piece from, for example, GAISi or steel.

On the outermost edge of the outside of the door leaf (36) a reinforcing edge (52) projects at right angles to the main surface of the door leaf (36). This edge affords that section of the door leaf which projects beyond the enveloping rib (42) such rigidity that this peripheral area can not be sheared off when pressure is exerted on the pressure side (38). Below this peripheral area to which reference has just been made there is a seal (54) (details evident from FIG. 3). From this Figure it will be evident that the seal (54) consists essentially of a strip of elastic material. When the door is closed the region 56 first comes in contact with the outer surface of the wall (22): this is achieved by means of the angular section of the inner surface of the overlapping area.

A sealing shaft (58) which can transverse a distance of approximately 25 cm and which is sealed by O-rings so as to be impervious to gas passes through the center point (40). It is mounted transversely to the door leaf (36). This shaft forms on the pressure side (38) a square protuberance on which an activating lever or wheel can be mounted. A device for activating the shaft is mounted permanently on the end of the shaft that is on the inside. The sealing shaft (58) is linked in the familiar way with eccentric connections (60) to which locking bails are attached. Each of these is mounted in bearings (62) which are mounted on the free ends of ribs. Each free end of a locking bail is aligned to one of the pockets (34). In each of the pockets there is mounted transversely to the entry/exit axis of the door opening a pair of moveable, adjustable sealing blocks (64), each sealing block having a slanted face so that the free end of the sealing rod (64) can be the more easily inserted. The sealing blocks (64) are adjusted in such a way that when the locking bails (66) are fully extended (see FIG. 2) the seal (54) is pressed against the wall (22) around the total circumference as is shown, for example, in FIG. 3. By means of the adjustability of the sealing blocks (64) it is possible to compensate for unevenness on the surface of the wall (22) as well as discrepancies in the dimensions of the door leaf (36).

The pockets (34) are constructed as follows: A box (70) which is made of steel plate and which has an opening for the insertion of the locking bails (66) is constructed in the wall (22) and firmly embedded in it. Two sealing blocks (64) are mounted in each of these boxes. These blocks are adjustable transversely to the main surface of the door leaf (36) and at the same time rendered elastic by means of springs (pressure coil-springs: 72) which stress the sealing blocks in this direction. Adjustment is achieved in this way: The sealing block that faces the door leaf (36) presses the free end of the lock bails (66) against the protective side (46), thereby forcing the protective seal (54) against the outside surface of the wall (22). When a shock wave is felt the free end of the lock bails (66) can move with the pressure, but it will not he sheared off. In this way the protective door is able to withstand enormous dynamic stresses. In another version the springs (72) are not employed. In their place the free end of each of the lock bails (66) is joined elastically to the main section of the lock bail (66), thereby ensuring that the free ends are not sheared off by a pressure wave.

The bearing bolts (48) are mounted in supporting rods which are cited outside the actual door opening (24) and which are set in the wall (22). These supporting rods are incorporated when the concrete body of the wall is cast, and their inner diameter exceeds by several millimeters the external diameter of the bearing bolts (48) so that the door can be adjusted. The bearing bolts (48) are threaded on the protected side (46) and appropriately sealed (e.g. by a silicon mass or O-rings) so as to render the inside impervious to gas. The axial position of the bearing bolts can be adjusted by inserting a thinner or thicker washer in place of the washer (74) that is mounted between the head of the bearing bolt that accepts the hinge bolt (50) and the outer surface of the wall (22).

What is claimed is:

1. A protective door device for anti-aircraft installations and nuclear power stations comprising a door opening in a wall that is constructed of concrete, the door opening exhibiting a door jamb in which pockets for adjustable elastic engagement of lock bails are arranged; two bearing bolts which are inserted near the door opening and on which two door hinges are mounted; and a closeable, protective door overlapping said door opening having a central lock and a reinforced metal door leaf exhibiting a bowl-shaped outer surface and an inner surface which door leaf comprises the said lock bails, from which door leaf support arms project that carry the said door hinges, a reinforcing ridge protrudes from the outer edge of the bowl-shaped outer surface of the door leaf transverse to the main plane of the door leaf and completely encircles said door leaf, and a reinforcing rib is arranged on the inner side of the door leaf, which rib completely encircles the door leaf, the external measurements of this rib are minimally smaller than the inner measurements of the door opening.

2. The protective door device according to claim 1, wherein the door leaf is, with the exception of some reinforcing ribs, essentially symmetrical when turned through 180 degrees.

3. The protective door device according to claim 1, wherein a seal is mounted outside of the rib completely encircling the door leaf and on the inner surface of the door leaf where the door leaf overlaps the door opening.

4. The protective door device according to claim 3, wherein seal exhibits a sealing surface, which first makes contact with the door opening when the door is closed.

5. The protective door device according to claim 1, wherein the rib completely encircling the door leaf and further ribs, ends in a plane that runs parallel to the main plane of the door leaf.

6. The protective door device according to claim 1, wherein a plate is mounted on the inner surface of the door leaf, whereby hollow spaces are formed between the door leaf and said plate.

7. The protective door device according to claim 1, wherein in each of the pockets a pair of locking blocks with diagonal inlet are mounted, which locking blocks are adjustable transversely to the main plane of the door opening.

8. The protective door device according to claim 1, wherein next to the door opening two supporting rods are firmly embedded.

* * * * *